United States Patent [19]

Rowe

[11] 4,394,134

[45] Jul. 19, 1983

[54] REDUCING FUEL CONSUMPTION WITH A FLUORINATED COMPOUND

[75] Inventor: Carleton N. Rowe, Yardley, Pa.

[73] Assignee: Mobil Oil Corporation, New York, N.Y.

[21] Appl. No.: 92,861

[22] Filed: Nov. 9, 1979

Related U.S. Application Data

[63] Continuation-in-part of Ser. No. 866,084, Dec. 30, 1977, abandoned.

[51] Int. Cl.[3] ..... C10L 1/20

[52] U.S. Cl. ..... 44/62; 44/70; 44/79; 252/54.6

[58] Field of Search ..... 44/70, 79, 62; 252/54.6

[56] References Cited

U.S. PATENT DOCUMENTS 4,039,301 8/1977 Laity ..... 44/70

*Primary Examiner*—Charles F. Warren
*Assistant Examiner*—Y. Harris-Smith
*Attorney, Agent, or Firm*—Charles A. Huggett; Michael G. Gilman; Claude E. Setliff

[57] ABSTRACT

Polymerizable (that is, e.g., monomeric) polyfluorinated compounds, when added to a lubricant or to a liquid hydrocarbon fuel, as for example gasoline, will cause a reduction in fuel consumption. Reduced fuel consumption may also be realized for long periods from pistons and/or cylinder walls so coated with one or more of the polymerizable compounds.

10 Claims, No Drawings

REDUCING FUEL CONSUMPTION WITH A FLUORINATED COMPOUND

CROSS REFERENCE TO RELATED APPLICATIONS

This application is a continuation-in-part of application Ser. No. 866,084, filed Dec. 30, 1977, now abandoned.

BACKGROUND OF THE INVENTION

1. Field of the Invention

The invention relates to fuel economy measures. In particular it relates to reducing fuel consumption by having present in the combustion environment of an internal combustion engine a polymerizable (e.g., monomeric) polyfluorinated compound.

2. Discussion of the Prior Art

For several years there have been numerous efforts to reduce the amount of fuel consumed by automobile engines and the like. The search for ways to do this was given added impetus by the oil embargo. Many of the solutions have been strictly mechanical, as for example, setting the engine for a leaner burn or simply building smaller cars and smaller engines.

Other efforts have revolved around finding lubricants that reduce the overall friction in the engine, thus allowing a reduction in energy requirements thereto. A considerable amount of work has been done with mineral lubricating oils and greases, modifying them with additives to enhance their friction properties. On the other hand, new lubricants have been synthesized and compounded for use in modern engines. Among these is Mobile 1, a synthetic fluid which is known to reduce fuel consumption by a significant amount. It is, however, the physical properties of the oil itself that provide improved lubrication (and thus improved fuel consumption) and not the additives present.

So far as is known, no efforts have been made to place polymerizable polyfluoro compounds in hydrocarbon fuels. U.S. Pat. No. 2,715,107 teaches a cold weather lubricant containing a perfluoro-organic acid or a derivative thereof. The acids include perfluoroacetic acid, perfluoropropionic acid and the like.

U.S. Pat. No. 3,794,473 is concerned with a motor fuel containing an anti-knock amount of a rare earth B-ketoenolate, which may contain fluorine. A lubricating oil containing a product of reaction between an aromatic amine and a fluorinated monobasic saturated carboxylic acid is disclosed in U.S. Pat. No. 3,634,242. A complex material, 4,4-bis(trifluoromethyl-2,2,2-triphenyl-3-(triphenylphosphoranylidene)-1,2-oxaphosphetane, its thermal cleavage product or the acid adducts of either are taught by U.S. Pat. No. 3,488,408 to be useful as additives to petroleum products. Finally U.S. Pat. No. 4,039,301 discloses the addition of polymeric pentadecafluoro octyl methacrylate to gasoline.

SUMMARY OF THE INVENTION

In accordance with the invention, there is provided a method for decreasing fuel consumption in an internal combustion engine by adding to the lubricating oil or hydrocarbon fuel used a polymerizable polyfluorinated monomer of the formula $$\longrightarrow RCH_2OC(=O)-C(R')=CHR''$$

wherein R, R' and R'' are as defined hereinbelow, and polymerizing said monomer during engine operation to form an amount of a polymer thereof to effect a reduction in fuel consumption of said engine. It will be understood that the invention will include dispersing or dissolving a monomer of the polyfluoro compound in a lubricating oil or liquid hydrocarbon fuel, especially gasoline.

DESCRIPTION OF SPECIFIC EMBODIMENTS

The monomers which are polymerized in situ and used in the method and compositions of this invention have the formula:

$$\longrightarrow RCH_2OC(=O)-C(R')=CHR''$$

wherein R is a $C_3$ to $C_{17}$ aliphatic hydrocarbon group, preferably alkyl, containing from 5 to 35 fluoride groups, R' is hydrogen or a hydrocarbyl chain containing from 1 to 3 carbon atoms and R'' is hydrogen or a hydrocarbyl chain containing 1 to 18 carbon atoms.

In general these compounds can be made in accordance with the method outlined in Org. Syn. Coll. Vol. 4, 977 (1963), which is incorporated herein by reference.

The amount of monomer that one can dissolve in the oil or fuel will vary widely, depending upon the solubility of it in these media. This solubility will depend largely on the amount and kind of fluorocarbon incorporated in the monomer. In general however, sufficient solubility can be attained if the fluorine content in the monomer is kept within the limits specified hereinabove. It has been found that a substantial reduction in fuel consumption can be attained if the lubricating oil initially contains from about 0.05% to about 3% by weight of the monomer, preferably about 0.1% to about 1%. The fuel, at least initially, should have from about 0.001% to about 0.5% by weight of the monomer, preferably from about 0.01% to about 0.1%.

We have found that when the monomer is placed in the fuel, the reduction in fuel consumption can be achieved without constant use of additive plus fuel. That is to say, when the monomer is initially added to the fuel, maximum advantage will be attained after a period of operation and the advantage will persist without further additional monomer entering the combustion chamber with the fuel. It has been found that this persistence remained until the tests were terminated, i.e., for about twelve hours. How long this effect is retained is not known at present.

It is, of course, not the monomer per se that provides the fuel economy. A polymerization of the monomer takes place in the combustion environment, whether it is placed in the oil or the fuel. It is not known absolutely, but I believe that the polymer produced is deposited on the metal surfaces with which the fuel or lubricating oil comes into contact. Strong evidence of this is found in the continuing fuel consumption reduction attained after initial use of additive in a fuel, followed by use of a fuel containing no additive.

That such in situ polymerization of the monomers disclosed hereinabove could effect a reduction in fuel consumption was indeed surprising, especially in view of U.S. Pat. No. 4,039,301, which set forth a set of four necessary criteria for the polymer, to wit:

(1) a critical surface tension of less than 17 dynes/centimeter at 25° C.;

(2) a high contact angle of at least 40° to toluene at 22° C;

(3) a minimum solubility in gasoline of at least about 5 parts by weight per million; and (4) a fluorine content in the range of from about 20 to about 65% by weight.

I certainly could not have expected that an in situ reaction would give a polymer having all these critical parameters.

The lubricating oils contemplated for use with the monomers include both mineral and synthetic oils. The synthetic oils include hydrocarbon oils, which embrace (1) long chain alkanes such as cetane, (2) olefin polymers such as trimers and tetramers of octene and decene, (3) ester oils such as pentaerythritol esters of monocarboxylic acids having 2 to 20 carbon atoms, (4) polyglycol ethers, (5) polyacetals, (6) siloxane fluids and the like. Especially useful are those synthetic esters which are becoming more and more popular, particularly in aviation. These include esters made from polycarboxylic acids and monohydric alcohols or from monocarboxylic acids and polyhydric alcohols. Among these, the most preferred members are those made from pentaerythritol, or mixtures thereof with di- and tripentaerythritol, and an aliphatic monocarboxylic acid containing from 1 to about 20 carbon atoms or a mixture of such acids.

The liquid hydrocarbon fuels that may be used in this invention include petroleum distillate fuel oils having an initial boiling point from about 75° F. to about 135° F., and an end boiling point from about 250° F. to about 1,000° F. It should be noted, in this respect, that the term 37 distillate fuel oils" is not intended to be restricted to straight-run distillate fractions. These distillate fuel oils can be straight-run distillate fuel oils, catalytically or thermally cracked (including hydro cracked) distillate fuel oils, or mixtures of straight-run distillate fuel oils, naphthas and the like, with cracked distillate stocks. Moreover, such fuel oils can be treated in accordance with well-known commercial methods, such as acid or caustic treatment, hydrogenation, solvent refining, clay treatment, and the like.

The distillate fuel oils are characterized by their relatively low viscosity, pour point and the like. The principal property which characterizes their contemplated hydrocarbons, however, is their distillation range. As herein before indicated, this range will lie about 75° F. and about 1,000° F. Obviously, the distillation range of each individual fuel oil will cover a narrower boiling range, falling nevertheless, within the above-specified limits. Likewise, each fuel oil will boil substantially, continuously, throughout its distillation range.

Particularly contemplated among the fuel oils are Nos. 1 and 3 fuel oils, used in heating and as Diesel fuel oils, gasoline, turbine fuels and the jet combustion fuels, as previously indicated. The domestic fuel oils generally conform to the specifications set forth in ASTM Specification D396-48T. Specifications for Diesel fuels are defined in ASTM Specification D975-48T. Typical jet fuels are defined in Military Specification MIL-F-5624B.

Having described the invention in broad general terms, the following are offered as specific illustrations.

The data presented in the following tables were obtained using 1H, 1H-pentadecafluorooctyl methacrylate PDFM as the monomer. This material was purchased. The compound has the formula:

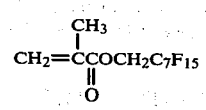

All data summarized in the tables below were obtained on a 2½ or 3½ HP Tecumseh engines. Test conditions were 2400 RPM and 70 psi pump pressure.

Test in lubricants

TABLE 1

FUEL CONSUMPTION FOR PDFM IN MOBILOIL SAE 10W
Mobil Regular Fuel

| 2½ HP Tecumseh Engine #1 | | | |
|---|---|---|---|
| Mobiloil SAE 10W | | 2.0% PDFM in Mobiloil SAE 10W | |
| cc/min. | Avg. cc/min. | cc/min. | Avg. cc/min. |
| 5.808 | 5.793 | 5.605 | 5.613 |
| 5.778 | | 5.621 | |
| 5.832 | 5.802 | 5.641 | 5.625 |
| 5.773 | | 5.608 | |
| 5.854 | 5.856 | 5.660 | 5.658 |
| 5.857 | | 5.665 | |
| 5.835 | 5.855 | 5.695 | 5.692 |
| 5.874 | | 5.688 | |
| 5.766 | 5.773 | | |
| 5.780 | | | |
| 5.846 | 5.845 | | |
| 5.843 | | | |
| 5.771 | 5.777 | | |
| 5.783 | | | |
| Average | 5.814 | | 5.647 |
| 90% Conf. Limits | +0.027 | | ±0.042 |
| Additive Benefit | | | 2.9% |
| 0.5% PDFM in SAE 10W | | 1.0% PDFM in SAE 10W | |
| cc/min. | Avg. cc/min. | cc/min. | Avg. cc/min. |
| 5.706 | 5.738 | 5.654 | 5.665 |
| 5.769 | | 5.676 | |
| 5.753 | 5.774 | | |
| 5.794 | | | |
| Average | 5.756 | | |
| Additive Benefit | 1.0% | | 2.6% |
| 3½ HP Tecumseh Engine #2 | | | |
| Mobiloil SAE 10W | | 2% in SAE 10W | |
| cc/min. | Avg. cc/min. | cc/min. | Avg. cc/min. |
| 5.506 | 5.632 | 5.459 | 5.448 |
| 5.758 | | 5.437 | |
| 5.571 | 5.586 | 5.444 | 5.456 |
| 5.601 | | 5.469 | |
| 5.684 | 5.682 | | |
| 5.681 | | | |
| 5.690 | 5.714 | | |
| 5.738 | | | |
| 5.673 | 5.654 | | |
| 5.635 | | | |
| Average | 5.654 | | 5.452 |
| Additive Benefit | | | 3.6% |

TABLE 2

| FUEL CONSUMPTION FOR PDFM IN MOBIL 1 2½ HP Tecumseh Engine #1 Mobil Regular Fuel | | | | | |
|---|---|---|---|---|---|
| Mobil 1 | | 1.0% PDFM in Mobil 1 | | 2.0% PDFM in Mobil 1 | |
| cc/min. | Avg. cc/min. | cc/min. | Avg. cc/min. | cc/min. | Avg. cc/min. |
| 5.848 | 5.836 | 5.794 | 5.798 | 5.780 | 5.726 |
| 5.824 | | 5.802 | | 5.673 | |
| 5.855 | 5.832 | | | | |
| 5.809 | | | | | |
| Average | 5.834 | | | | |
| Additive Benefit | | 0.6% | | | 1.9% |

TABLE 3

| FUEL CONSUMPTION FOR PDFM IN FUEL 2½ HP Tecumseh Engine #1 Mobiloil SAE 10W (5.814 cc/min; Table 1) | | |
|---|---|---|
| 0.5% PDFM in Mobil Regular Fuel | | |
| cc/min. | Test cc/min. | Remarks |
| 5.682 | 5.606 | Film forming in 1st run |
| 5.531 | | |
| 5.517 | 5.501 | 5.4% Reduction in Fuel |
| 5.485 | | Consumption |

Following the run summarized in Table 3, the oil in the engine was changed and the fuel on restart contained no additive. Table 4 shows the results.

TABLE 4

| cc/min. | Avg. cc/min. | Remarks |
|---|---|---|
| 5.528 | 5.504 | Test after 50 cc of fuel |
| 5.480 | | was consumed |
| 5.589 | 5.454 | |
| 5.319 | | |
| 5.474 | 5.466 | |
| 5.457 | | |
| Average | 5.474 | |

As can be seen by comparing these results with those shown above, the additive effect persisted with fuel which did not contain the additive.

TABLE 5

| 2½ HP Tecumseh Engine #1 (Cleaned) Mobiloil SAE 10W | | | |
|---|---|---|---|
| Mobil Unleaded Fuel | | 0.1% PDFM in Mobil Unleaded Fuel | |
| cc/min. | Avg. cc/min. | cc/min. | Avg. cc/min. |
| 4.542 | 4.531 | 4.378 | 4.348 |
| 4.519 | | 4.317 | |
| 4.566 | 4.549 | 4.336 | 4.338 |
| 4.531 | | 4.339 | |
| | | 4.332 | 4.330 |
| | | 4.328 | |
| Average | 4.540 | | 4.339 |
| Additive Benefit | | | 4.4% |

TABLE 6

| 2½ HP Tecumseh Engine #1 (Cleaned) Mobiloil SAE 10W | | |
|---|---|---|
| cc/min. | Test cc/min. | Remarks |
| 0.5% PDFM in Mobil Unleaded Fuel | | |
| 4.736 | 4.736 | |
| 4.736 | | |
| New Oil and Mobil Unleaded Fuel (no additive) | | |

TABLE 6-continued

| 2½ HP Tecumseh Engine #1 (Cleaned) Mobiloil SAE 10W | | |
|---|---|---|
| cc/min. | Test cc/min. | Remarks |
| 4.739 | 4.744 | Engine operated 4.5 hrs. |
| 4.748 | | before test |
| 4.747 | 4.738 | Engine operated 8.5 hrs. |
| 4.730 | | before test |

TABLE 7

| FUEL CONSUMPTION FOR PDFM IN FUEL 3½ HP Tecumseh Engine #2 Mobiloil SAE 10W | | | |
|---|---|---|---|
| Ref. Fuel AE-190A* | | | |
| cc/min. | | | Test cc/min. |
| 5.833 | | | 5.859 |
| 5.885 | | | |
| 5.802 | | | 5.835 |
| 5.867 | | | |
| Average | | | 5.847 |
| 0.5% PDFM in AE-109A Fuel | | | |
| Test No. | Run | cc/min. | Test cc/min. |
| 2R2-3-3 | A | 5.399 | 5.423 |
| | B | 5.447 | |
| Additive Benefit | | | 7.3% |

*Lead-free EPA reference fuel

What is claimed is:

1. A method for decreasing fuel consumption in an internal combustion engine by adding to the lubricating oil or liquid hydrocarbon fuel used therein a sufficient amount of a polymerizable polyfluoro monomer compound of the formula $$RCH_2OC(=O)-C(R')=CHR''$$

wherein R is a $C_3$ to $C_{17}$ aliphatic hydrocarbon group containing from 5 to 35 fluoride groups, R′ is hydrogen or a $C_1$–$C_3$ hydrocarbyl group and R″ is hydrogen or a $C_1$–$C_{18}$ hydrocarbyl group and polymerizing said monomer during engine operation to form an amount of a polymer thereof to effect a reduction in fuel consumption of said engine.

2. The method of claim 1 wherein the monomer is $$C_7F_{15}CH_2OC(=O)-C(CH_3)=CH_2$$

3. The method of claim 1 wherein in the lubricating oil the concentration of the monomer is from about 0.05% to about 3% by weight.

4. The method of claim 3 wherein the concentration of the monomer is from about 0.1% to about 1% by weight.

5. The method of claim 1 wherein the concentration of the monomer in the liquid fuel is from about 0.001% to about 0.5% by weight.

6. The method of claim 5 wherein the concentration of the monomer is from about 0.01% to about 0.1% by weight.

7. The method of claim 1 wherein the lubricating oil is a mineral oil.

8. The method of claim 1 wherein the fuel used is gasoline.

9. The method of claim 8 wherein said gasoline is lead-free.

10. The method of claim 8 wherein said gasoline contains lead.

* * * * *

UNITED STATES PATENT AND TRADEMARK OFFICE

CERTIFICATE OF CORRECTION

PATENT NO. : 4,394,134

DATED : July 19, 1983

INVENTOR(S) : Carleton N. Rowe

It is certified that error appears in the above—identified patent and that said Letters Patent is hereby corrected as shown below:

Column 1, line 36, change "Mobile" to --Mobil--.

Signed and Sealed this

*Fourteenth* Day of *February 1984*

[SEAL]

*Attest:*

GERALD J. MOSSINGHOFF

*Attesting Officer*

*Commissioner of Patents and Trademarks*